US006605158B1

(12) United States Patent
Martin

(10) Patent No.: US 6,605,158 B1
(45) **Date of Patent: *Aug. 12, 2003**

(54) RADIOACTIVE DECONTAMINATION AND TRANSLOCATION METHOD

(75) Inventor: Robert T. Martin, Delta, UT (US)

(73) Assignee: Bobolink, Inc., Delta, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/283,039

(22) Filed: Oct. 24, 2002

Related U.S. Application Data

(63) Continuation-in-part of application No. 09/976,467, filed on Oct. 12, 2001, now Pat. No. 6,497,769.

(51) Int. Cl.[7] ..... B08B 3/04

(52) U.S. Cl. ..... 134/10; 134/2; 134/3; 134/26; 134/28; 134/36; 134/41; 134/42; 134/22.19; 510/110; 376/308; 376/309; 376/310; 423/2; 423/3; 423/20; 588/1; 588/20; 210/682; 210/688; 976/DIG. 376; 976/DIG. 391

(58) Field of Search ..... 134/2, 3, 10, 26, 134/28, 36, 22.19, 41, 42; 510/110; 376/308, 309, 310; 423/2, 3, 20; 588/1, 20; 210/682, 688; 976/DIG. 376, DIG. 391

(56) References Cited

U.S. PATENT DOCUMENTS

| | | | | | |
|---|---|---|---|---|---|
| 2,758,970 | A | * | 8/1956 | Savkaitis | 252/8.55 |
| 3,033,794 | A | | 5/1962 | Morris | 252/135 |
| 3,359,078 | A | | 12/1967 | Alter et al. | 23/326 |
| 4,161,447 | A | | 7/1979 | Kojima | 210/231.1 |
| 4,729,855 | A | | 3/1988 | Murray et al. | 252/626 |
| 5,024,821 | A | * | 6/1991 | Greenshields et al. | 423/23 |
| 5,045,273 | A | | 9/1991 | Gassen et al. | 376/309 |
| 5,049,297 | A | | 9/1991 | Morris et al. | 252/80 |
| 5,200,117 | A | | 4/1993 | Morris et al. | 252/626 |
| 5,322,644 | A | | 6/1994 | Dunn et al. | 252/626 |
| 5,434,331 | A | | 7/1995 | Barkatt et al. | 588/1 |
| 5,545,794 | A | | 8/1996 | Bray | 588/1 |
| 5,591,270 | A | | 1/1997 | D'Muhala | 134/3 |
| 5,613,239 | A | | 3/1997 | Obinata et al. | 588/1 |
| 5,678,232 | A | | 10/1997 | D'Muhala | 588/1 |
| 5,752,206 | A | | 5/1998 | Frink et al. | 134/3 |
| 5,824,159 | A | | 10/1998 | Tate | 134/3 |
| 5,833,395 | A | | 11/1998 | Fletcher et al. | 405/128 |
| 5,852,786 | A | | 12/1998 | Bradbury et al. | 588/1 |
| 5,997,658 | A | | 12/1999 | Peters et al. | 134/38 |
| 6,176,917 | B1 | | 1/2001 | Duclaud et al. | 106/211.1 |
| 6,203,624 | B1 | | 3/2001 | Bargues et al. | 134/3 |
| 6,214,189 | B1 | | 4/2001 | Won et al. | 204/515 |
| 6,497,769 | B1 | * | 12/2002 | Martin | 134/10 |

FOREIGN PATENT DOCUMENTS

| | | | |
|---|---|---|---|
| GB | 2065092 | A | 12/1979 |
| JP | 357111244 | A | 7/1982 |
| JP | 59174800a | * | 10/1984 |
| JP | 11202086 | A | 7/1999 |

* cited by examiner

*Primary Examiner*—Sharidan Carrillo
(74) *Attorney, Agent, or Firm*—Thorpe North & Western, LLP

(57) ABSTRACT

A method for removing radioactive contaminants from a given surface. An aqueous solution having a wetting agent and a complex substituted keto-amine is provided. The solution is left on the surface for a time sufficient to remove the radioactive contaminants into the aqueous solution which is then removed. Depending on the type and condition of the surface, a concentrated acid may be added to the aqueous solution to aid in the contaminant removal process. In such a case, a pH of less than 3.0, and preferably less than 1.5 is maintained. If a concentrated acid is used, the acidic solution containing radioactive contaminants is preferably neutralized by an alkaline material to a pH of between 5.5 and 9.0. Removal of thorium contamination from railcars is one useful application of the invention. The method of the present invention has the effect of removing substantially all of the radioactive contaminants from a previously contaminated surface.

27 Claims, No Drawings

RADIOACTIVE DECONTAMINATION AND TRANSLOCATION METHOD

PRIORITY INFORMATION

This application is a continuation-in-part of co-pending U.S. patent application Ser. No. 09/976,467, filed Oct. 12, 2001, issued as U.S. Pat. No. 6,497,769 on Dec. 24, 2002, which is hereby incorporated by reference.

BACKGROUND OF THE INVENTION

The present invention relates generally to a method for decontamination of surfaces. More particularly, the present invention relates to using an aqueous solution having particular compositions to remove radioactive contaminants from a given area, location or surface.

Contamination of various areas or surfaces from radioactive or other unwanted materials is a common problem. The contamination of an area or surface may occur as a result of contact with a radioactive isotope during transport, storage, use in a nuclear reactor, mining operations, or a variety of other industrial or military processes. In recent years, methods have been explored to reduce or remove such contaminants from various areas or surfaces and equipment so that such items or areas may be put back into use and the contaminants be disposed of safely. These methods have met with varying success and often present trade-offs between decontamination of the surface or area and the toxicity of the waste product containing the radioactive contaminant.

One method of removing radioactive materials is to physically wash the contaminated area or surface with water and an optional surface-active agent. However, such methods are generally limited to physical separation of contaminants that are not physically or chemically adhered to surfaces or areas. Thus, this method does not work well where the contaminants are chemically bound or physically adhered to a solid surface or structure.

For example, a number of methods have been developed to remove radioactive contaminated scale or rust deposits from metal surfaces. The radioactive substances are removed in a solution that is transported at safe levels for disposal. However the concentrated radioactivity found in scale or rust adhering to surfaces presents increased danger and cost in removal and disposal. Depending on the type of scale or rust deposit either acidic or basic removal treatments may be appropriate. U.S. Pat. No. 5,200,117, 5,049,297 and 5,824,159 illustrate typical approaches to removing radioactive substances in these situations.

Another method for removing contaminants from surfaces or areas, which are not necessarily limited to deposited scales, is known generally as acid leaching. In acid leaching methods, a strong acid is used to dissolve radioactive contaminants from the surface into solution. The resulting solution is removed and disposed of leaving a clean, or at least a reduced amount of radioactive contaminants, on the surface. Such acid leaching processes may or may not use chelating agents.

Chelating agents have been the subject of much research in this area and include ligand or binding agents such as oxalate, citrate, gluconate, picolinate, EDTA, hydrazines with carboxylic acids, and hydroxamic acids. Acidic and basic solutions containing a chelating agent are used to dissolve and bind contaminants depending on the characteristics of the surface and the contaminants. When used to remove radioactive substances from contaminated areas, the chelating agent is thought to have the effect of stabilizing certain dissolved radioactive contaminants to keep them in solution. Several of these methods use concentrated carbonate solutions to recover uranium, thorium, radium, technetium, and other actinides.

With several of these methods, a separate ion-exchange process is used to purify the resulting solution to make disposal of the radioactive contaminants easier.

In addition to these challenges, other considerations include providing a decontaminating agent and method which is not excessively corrosive and is easy to prepare and use. Further, the solution containing removed contaminants should preferably be easily disposed of in compliance with state and federal regulations. It would therefore be a significant advancement and contribution to the art to provide a method which is a simple, economic, and an effective way of removing substantially all of the radioactive contaminants from various surfaces or areas.

SUMMARY OF THE INVENTION

While many methods for removing radioactive or other unwanted contaminants have been developed there remains the need for improved decontamination methods which speed up the decontamination process and remove substantially all of the radioactive contaminants. The present invention relates to the removal of radioactive contaminants from a surface or area using an aqueous solution which includes a wetting agent and an active agent. The active agent may be a complex substituted keto-amine, linear alcohol alkoxylate, ethoxylated alkyl amine, or mixtures of these. The aqueous solution is applied to a radioactively contaminated surface and retained on the surface for a period of time sufficient to allow at least a portion of the radioactive contaminants to migrate into the aqueous solution. The contaminant rich aqueous solution is then removed from the surface for further treatment or disposal.

In one aspect of the present invention the active agent is a complex substituted keto-amine having the molecular formula $C_{33}H_{45}NO_2.ClH$.

In a more detailed aspect of the present invention the wetting agent is a lower alcohol such as methanol, ethanol, propanol, isopropanol, butanol, propargyl alcohol, tertiary butyl alcohol, pentanol, and mixtures of these alcohols.

In another aspect of the present invention, the aqueous solution includes a concentrated acid such as hydrochloric acid, hydrofluoric acid, sulfuric acid, phosphoric acid, sulfurous acid, bromic acid, iodic acid, nitric acid, perchloric acid, oxalic acid, aqua regia, citric acid, sulfamic acid, glycolic acid, ascorbic acid, and mixtures thereof. In a more detailed aspect, the resulting acidic solution using one or more of the above acids has a pH of less than 1.5.

In accordance with yet another more detailed aspect of the present invention, the method is used to remove radioactive contaminants, and particularly those found in the actinide and lanthanide series such as thorium, uranium, and plutonium. Exemplary of radioactive contaminants, some of which are in the actinide and lanthanide series, are Actinium-227, Americium-241, Americium-243, Antimony-124, Antimony-125, Barium-133, Beryllium-7, Bismuth-207, Cadmium-109, Calcium-45, Carbon-14, Cerium-139, Cerium-141, Cerium-144, Cesium-134, Cesium-135, Cesium-137, Chromium-51, Cobalt-56, Cobalt-57, Cobalt-58, Cobalt-60, Copper-67, Curium-242, Curium-243, Curium-244, Curium-247, Europium-152, Europium-154, Europium-155, Gadolinium-153, Germanium-68, Gold-195, Hafnium-181, Hydrogen-3(Tritium), Iodine-125, Iodine-126, Iodine-129, Iodine-131, Iodine-133, Iridium-192, Iron- 55, Iron-59, Lead-210, Manganese-54, Mercury-203, Neptunium-237, Nickel-59, Nickel-63, Niobium-94, Plutonium-236, Plutonium-238, Plutonium-239, Plutonium-240, Plutonium-241, Plutonium-242, Plutonium-243, Plutonium-244, Polonium-210, Potassium-40, Promethium-147, Protactinium-231, Radium-223, Radium-224, Radium-226, Radium-228, Ruthenium-106, Samarium-151, Scandium-46, Selenium-75, Silver-108m, Silver-110m, Sodium-22, Strontium-85, Strontium-89, Strontium-90, Sulfur-35, Tantalum-182, Technetium-99, Thallium-204, Thorium-natural, Thorium-228, Thorium-230, Thorium-232, Tin-113, Uranium-232, Uranium-233, Uranium-234, Uranium-235, Uranium-236, Uranium-238, Uranium-natural, Uranium-depleted, Yttrium-88, Yttrium-91, Zinc-65, Zirconium-95 and associated decay products of these contaminants.

In accordance with another aspect of the present invention, the method is applied to a solid surface or area as defined above which comprises metal, plastic, glass, concrete, wood, fiberglass, soil, natural or synthetic fabrics, or any other material.

In general, the method comprises applying the aqueous solution, as hereinafter defined, in such a manner as to contact the radioactive contaminant and remove it from the surface or area to which it is associated into the solution. Such application techniques may be by spraying, wiping, soaking, immersing and the like. Once applied to a surface it is important that the solution be removed before the solution dries on the surface. Otherwise, the radioactive contaminant would not be removed. Hence, the time the solution is on the surface may be relatively short or long, depending on the wetting time and application process. It may be more efficient to sequentially apply more than one application and removal step to adequately remove the radioactive decontaminate from the surface. The length of time between the application and removal steps may vary from a few seconds to several minutes depending on the condition of the surface and the amount radioactive contaminant to be removed. Any suitable removal technique, such as a squeegee, wiper blade, vacuum, gravity flow, wringer, centrifuge, and the like may be used to remove the solution from the surface.

In yet another more detailed aspect of the present invention, the application and removal steps may be repeated more than once to remove further portions of the contaminants from the surface. Consecutive treatments may use the same aqueous solution composition or different compositions.

Finally, in accordance with another aspect of the present invention the collected acidic solution containing the removed radioactive contaminant may be treated to neutralize the pH. The collected acidic solution may be treated by adding sodium hydroxide or any other suitable neutralizing agent to obtain a pH of greater than about 5.5, and preferably about 7 to about 9 to form a waste solution.

Additional features and advantages of the invention will be apparent from the detailed description which follows.

DETAILED DESCRIPTION

For the purposes of promoting an understanding of the principles of the invention, reference will now be made to exemplary embodiments, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As used herein, "on the surface", "from the surface", "in the area", "from the area" and the like is intended to cover removal of radioactive particles that are on, near, physically attached to, chemically attached to, embedded in, lodged in the interstices, or otherwise associated with the solid surface or area. As such, the method of the present invention allows for removing and dissolving any radioactive particles which are susceptible to contact with the decontamination solution regardless of the physical association or location of such particles in connection with such surface. One surface of particular importance is a porous metal surface, i.e. a surface which has been oxidized, e.g., contains rust, to which radioactive particles have become attached or embedded.

By "surface" or "area" is meant the presence of a contaminant on or about a surface or area that may include solid structures, such as trucks, equipment, and the like, particulate, compressible or linear solids such as soils, wires, gauzes, steel wool, fabric and the like. "Area" may also be used to define a location which may be inclusive of liquids such found in ponds, tanks, open or enclosed containers and is inclusive of such containers. In most instances, all contaminants will be associated in, on, attached to, embedded in or associated with a solid having a surface area.

As used herein, percentages refer to weight percentages unless otherwise specified. Further, one should note that the term "between" is used herein to identify a range and without the modifier "about" does not include the limit of the identified range. For example, "between 0.1% and about 3%" includes values ranging from about 3% by weight, as would be understood in the art down to, but not including 0.1%. Further, a concentration range of "about 1% to about 4.5%" should be interpreted to include not only the explicitly recited concentration limits of 1% to about 4.5%, but also to include individual concentrations such as 2%, 3%, 4%, and sub-ranges such as 1% to 3%, 2% to 4%, etc. The same principle applies to ranges reciting only one numerical value, such as "less than about 4.5%," which should be interpreted to include all of the above-recited values and ranges. Further, such an interpretation should apply regardless of the breadth of the range or the characteristic being described.

The present invention provides a method for removing radioactive contaminants from a contaminated surface or area. As previously noted, a decontamination solution is formed containing a wetting agent and an active agent. The wetting agent is provided to improve the penetration of the solution into the surface of the contaminated material. Although various wetting agents may be used in the present invention, lower alcohols such as methanol, ethanol, propanol, isopropanol, butanol, propargyl alcohol, tertiary butyl alcohol, pentanol, and mixtures of these alcohols provide good wetting properties to the decontamination solution. Other wetting agents include diols such as, but not limited to, propylene glycol, polypropylene glycol, and ethylene glycol.

The active agent of the present invention is provided to aid in the removal of radioactive portions of the contaminated material. Active agents of the present invention include complex substituted keto-amines, linear alcohol alkoxylates, ethoxylated alkyl amines, and mixtures of these agents.

The complex keto-amines of the present invention are rosin amine derivatives having the general formula

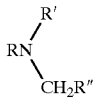

where R is selected from the group consisting of abietyl, hydroabietyl, and dehydroabietyl; wherein R" is an alpha ketonyl having fewer than 10 carbon atoms; and wherein R' is either H or $CH_2R''$. The alpha ketonyl group is derived from a ketone used in producing the keto-amine and may include any ketone but is typically a ketone having fewer than ten carbon atoms such as acetone, methyl ethyl ketone, diacetone alcohol, isophorone, mesityl oxide, pentane dione, acetonyl acetone, cyclopentanone, cyclohexanone, and acetophenone. The process for manufacture of these types of keto-amines is described more fully in U.S. Pat. No. 2,758,970, hereby incorporated by reference. One such complex substituted keto-amine has the molecular formula $C_{33}H_{45}NO_2$.ClH and may also be identified by the CA Index chemical name 2-Butanone, 4-[[[(1R,4aS,10aR)-1,2,3,4,4a,9,10,10a-octahydro-1,4a-dimethyl-7-(1-methylethyl)-1-phenanthrenyl]methyl](3-oxo-3-phenylpropyl)amino]-, hydrochloride (9Cl). Generally, complex substituted keto-amines will constitute less than about 10% and most often between about 1% and about 5% or between about 0.1% and about 2% by weight of the total decontamination solution. Decontamination solutions containing these active agents have shown good results on a wide variety of surfaces.

The linear alcohol alkoxylates of the present invention are ethoxylated and propoxylated alcohols having from six to fifteen carbons. Such linear alcohols are known by the CA Index name alkoxy, C6–10 or C12–15, ethoxylated propoxylated alcohols. The alkoxylates may be present in the decontamination solution at levels less than about 5% by weight of the total solution. Decontamination solutions containing between about 0.05% and about 5% have shown good results. Typically, these active agents require lower concentrations in this range and concentrations below about 1% work well for most surfaces.

The ethoxylated alkyl amines of the present invention are ethoxylated alkyl amines wherein the alkyl group is a long-chain alkyl having greater than seven carbon atoms. Such amines may be derivatives of a variety of oils such as coconut oil (ethoxylated coco alkyl amine), palm kernel oil, and other oils. Ethoxylated amines used in the present invention may constitute less than about 5% by weight of the total decontamination solution. Concentrations of ethoxylated amines may also range from about 1% to about 4% by weight of the total decontamination solution. This active agent has shown particularly good results on concrete and stainless steel surfaces.

The aqueous solution of the present invention may also include a concentrated acid. Typically, surfaces having a greater amount of scale, rust, or other layers of debris covering the contaminated area will require the concentrated acid. Surfaces which are substantially free of such debris most often do not require the addition of an acid to the aqueous solution of the present invention. The concentrated acid may be a strong acid such as hydrochloric acid, hydrofluoric acid, sulfuric acid, phosphoric acid, sulfurous acid, bromic acid, iodic acid, nitric acid, perchloric acid, oxalic acid, aqua regia and mixtures of such strong acids. Other acids such as citric acid, sulfamic acid, glycolic acid, and ascorbic acid may be used in the method of the present invention. Hydrochloric acid exhibits particularly good results and may be used in a concentrated aqueous solution of about 32% to 38% hydrochloric acid. The currently used concentration for hydrochloric acid is 37% which is then added to the aqueous solution in varying amounts. Concentrations of between about 1% and about 10% of hydrochloric acid have shown excellent results on some surfaces. When a concentrated acid is used the concentration may be sufficient to provide a pH of about 3 or lower and preferably about 1.5 or below and more preferably below about 1.0. These concentrated acids may be added to the decontamination solution alone or in combination with other acids.

Other additives or components may be added to the decontamination solution in order to enhance various properties of the solution. Such additives may include catalysts such as copper chloride, nickel chloride, iron chloride; basic components such as ammonium bifluoride or diammonium citrate or a variety of other additives such as surfactants or corrosion inhibitors.

Once the aqueous decontamination solution is prepared according the present invention the contaminated surface may be cleaned and prepared to remove any dirt, oil, dust, or other debris prior to applying the solution to the surface. If the surface contains organic materials, such as oils or certain surfactants, it may be preferable to clean the surface with other appropriate materials, solvents or cleaning agents such as acetone, methylethyl ketone, steam, strong surfactants, etc. The use of water and/or steam is acceptable, however the use of some surfactants was shown to reduce the effectiveness of the present invention. As noted above, the contaminated surface may be any solid surface which exhibits undesirable levels of radioactive particles such as thorium, uranium, plutonium, and other elements from the actinide and lanthanide series of the periodic table as well as other radioactive substance as previously listed. As also previously noted, such surfaces may include, but are not limited to metals, plastics, glass, wood, concrete, fiberglass, fabrics, and soil. Transportation equipment such as railcars, trucks, ships, forklifts, containers, pumps, covers and pipes often become radioactively contaminated during transport of waste materials and are particularly subject to being treated according to the present invention. Stationary surfaces such as buildings and process equipment are also often contaminated with radioactive particles. Other materials include polymeric materials, polyethylenes, rubbers, nuclear reactor equipment, spent nuclear fuel rods, and any other equipment, containers or parts which are used in handling, using, processing and transporting radioactive materials. It is to be understood that the above recited lists of various specific surfaces are intended to merely illustrate some of the types of surfaces which may be used in connection with the present invention, and are not intended to limit the scope thereof The decontamination solution is then applied to the contaminated surface. The aqueous decontamination solution may be applied using any conventional method such as spraying, immersing, brushing, wetting, providing a continuous flow of fresh solution (as through a pipe or over a surface), and any other method which produces direct contact of the decontamination solution with the contaminated surface. Although, a variety of application methods may be used as is known in the art, spraying and wetting have produced satisfactory results. Accordingly, the decontamination solution may be placed in a device which is capable of producing a spray or wetting action and is designed for highly acidic contents. Such spraying devices include without limitation hand spray bottles, lightweight sprayers, and industrial spraying machines (either manual or automated). In addition to spraying, an ultrasonic brush may be used on the surface which accelerates removal and lessens the treatment time. Such an ultrasonic brush has significantly decreased treatment times on vertical surfaces where the decontamination solution merely wets the surface. Although not fully understood, it is thought that the ultrasonic vibrations propagate through the solution at the surface and improves the ability of the wetting agent to penetrate into the surface at an increased rate over that without the ultrasonic treatment. Accordingly, ultrasonic waves directed toward the contaminated surface having a decontamination solution thereon should also increase the rate of contaminant removal according to the present invention.

The temperature of the decontamination solution may be whatever is functional and is preferably ambient temperature of less than about 32° C. At temperatures above this the decontamination solution vaporizes and does not decontaminate the surface. In other words, the aqueous solution usually does not require heating at temperatures above about 1 to 5° C.

Application rates and amounts are best determined empirically and are based on the amount or concentration of radioactivity on the contaminated surface, the depth of scale or rust containing the contamination on the surface, the surface area to be treated, whether sequential application and removal is desired, and the like. What is required is that a functional area or surface is treated with the aqueous solution and allowed to remain for a time sufficient to remove the radioactive materials that are contacted followed by removal of the contaminant containing solution. The area treated is limited to that which can adequately be treated and the solution removed by the operator. Generally speaking, the solution will remain on the surface for ten minutes or less and will preferably be on the surface for five minutes or less. However, for some operations the solution may remain for longer periods sufficient to translocate the radioactive particles from the surface. It may be preferable to treat the surface with a succession of treatments where the solution is applied and removed followed by sequential treatments of application and removal until the desired result is obtained. It is not the time or amount that is critical as these parameters may be empirically determined. For example, the treatment time will vary considerably depending on the type of surface treated, but is generally under twenty minutes. Typically, surfaces such as steel, iron and other metal surfaces will require shorter treatment times than more porous surfaces such as concrete, wood, plastic and fiberglass.

In a more detailed aspect of the present invention, sequential treatments are made using decontamination solutions having different compositions. Some contaminated surfaces may benefit from such a consecutive treatment process. For example, a first treatment of the surface may be made by applying a complex keto-amine solution and then removing the solution containing a portion of the radioactive contaminants as described above. A second treatment may then be made using another solution such as a linear alcohol alkoxylate solution or a solution containing a concentrated acid. Various combinations of consecutive treatments may be made based on routine experimentation by those skilled in the art. Experimentation has shown that repeated treatment using the same solution may not be as effective for reducing contamination as consecutive treatments using different solutions.

One important benefit of this invention is the speed and efficiency of the decontamination process. After treating the surface with the aqueous solution the solution containing the radioactive contaminants may be removed using conventional methods such as vacuuming, using a wiper blade or squeegee, rinsing or any other appropriate means and collected in a separate collection container. As previously mentioned, application times of less than about 5 minutes such as about 2 to 3 minutes have produced excellent decontamination results. The application and removal process may also be repeated and has the effect of increasing the rate of removing the contaminated particles.

After the decontamination solution is removed from the surface further treatment of the surface may be desirable. The resulting surface is often exposed bare metal and as such will oxidize and begin to corrode if left untreated. If necessary, treatment with corrosion inhibitors such as phosphoric acid and other known products may improve the long-term corrosion resistance of treated metal surfaces.

In another more detailed aspect of the present invention, the spent solution in the collection container containing the removed radioactive materials is neutralized to a pH of 5.5 to about 9.0 and preferably about 6 to about 8 by means of aqueous sodium or potassium hydroxides or other alkaline neutralizing agents. In order to increase efficiency the monitoring and addition of alkaline solution may be accomplished using automated equipment, although the process could be done manually. An alkaline solution, such as sodium hydroxide or potassium hydroxide is added to the collected solution which contains radioactive contaminants to reach a pH of greater than 5.5. A collected solution having a pH in the range of about 6.5 to 9 makes storage and disposal of the radioactive solution easier and safer.

Conventional means may be used to remove the neutralized contaminated solution to a suitable disposal site in accordance with established regulatory procedures. The neutralized contaminated solution exhibits very low disintegrations per minute (dpm) values and may therefore be readily disposed of according to existing Federal and State regulations.

EXAMPLES

The following examples are intended to further illustrate certain aspects of the present invention and should not be regarded as limiting the scope of the present invention. Unless otherwise noted, the following decontamination solutions were applied to a 12 inch by 12 inch section of radioactive contaminated steel.

Examples 1–5

Table 1 shows the results of several experiments using the method of the present invention measured in terms of disintegrations per minute (dpm) before and after treatment. Examples 1 through 4 used concentrated (37%) HCl containing 0.5% of the complex keto-amine having the molecular formula $C_{33}H_{45}NO_2.ClH$, 0.2% isopropyl alcohol, and 0.2% propargyl alcohol maintained at a pH below about 1.1. Experiment 5 consisted of only concentrated HCl solution also having a pH of below about 1.1. The results of experiment 5 indicate that the addition of the keto-amine and mixed alcohols had a noticeable effect on the dpm values.

TABLE 1

| Experiment | Decontamination Solution | Start beta (dpm) | Finish beta (dpm) | Reduction |
|---|---|---|---|---|
| 1 | Amine/Alcohol | 20,700 | NMA | 100% |
| 2 | Amine/Alcohol | 7,000 | NMA | 100% |
| 3 | Amine/Alcohol | 19,300 | NMA | 100% |

TABLE 1-continued

| Experiment | Decontamination Solution | Start beta (dpm) | Finish beta (dpm) | Reduction |
|---|---|---|---|---|
| 4 | Amine/Alcohol | 110,000 | NMA | 100% |
| 5 | HCl Only | 11,900 | 8,413 | 29% |

NMA = no measurable activity

Example 6

Several decontamination solutions were prepared and tested utilizing various acids but containing the same amount of the above keto-amine (0.5%), isopropyl alcohol (0.3%) and propargyl alcohol (0.3%). Each solution had a pH of 1.2 or below. The solutions were applied as a low-pressure spray, allowed to remain at the site for a period of about five minutes and then removed by a squeegee. The spent solution was neutralized to a pH of about 7, using a 50% NaOH solution. Surface contamination levels of both alpha and beta emissions were measured before and after treatment. The results are given in Table 2 as follows:

TABLE 2

| Acid | Alpha (dpm) | Beta (dpm) |
|---|---|---|
| Phosphoric (37%) pH ~1 | | |
| Before | 748 | 10,500 |
| After | 350 | 9,030 |
| % Reduction | 50.6% | 14% |
| Sulfuric (37%) pH ~1 | | |
| Before | 748 | 7,088 |
| After | 484 | 6,260 |
| % Reduction | 54.7% | 11.68% |
| Oxalic (10%) pH 1.2 | | |
| Before | 1,030 | 13,000 |
| After | 626 | 12,300 |
| % Reduction | 39.2% | 5.38% |
| Hydrochloric (37%) pH ~1 | | |
| Before | 2,640 | 17,400 |
| After | NMA | NMA |
| % Reduction | 100% | 100% |

NMA = No Measurable Activity

These results show degrees of effectiveness in removing radioactivity from 10 surfaces utilizing a strong acid combined with a keto-amine as the active agent and a mixture of lower alcohols. The results utilizing hydrochloric acid are clearly superior to the other acids demonstrated but all show the ability to reduce radioactive contamination.

Examples 7–15

Several experiments were performed using the complex substituted keto-amine having the molecular formula $C_{33}H_{45}NO_2.ClH$ as in Examples 1 through 6 and another component and are shown in Table 3. In each example the wetting agent is a mixture of isopropyl and propargyl alcohols of between 0.1 and 1.0% of the solution with water constituting the balance of the solution.

TABLE 3

| Example | Components | % | Time (min) | Start (dpm) | Finish (dpm) | Reduction |
|---|---|---|---|---|---|---|
| 7 | Keto-amine | 2 | 2 | 115,000 | NMA | 100% |
| | HCl | 36 | | | | |
| 8 | Keto-amine | 2 | 6 | 89,000 | NMA | 100% |
| | HCl | 15 | | | | |
| 9 | Keto-amine | 2 | 15 | 97,000 | NMA | 100% |
| | HCl | 10 | | | | |
| 10 | Keto-amine | 2 | 27 | 75,000 | NMA | 100% |
| | HCl | 5 | | | | |
| 11 | Keto-amine | 5 | 12 | 9,000 | 500 | 94% |
| | HCl | ~0 | | | | |
| 12 | Keto-amine | 2 | 20 | 42,000 | 12,000 | 71% |
| | Oxalic Acid | 10 | | | | |
| 13 | Keto-amine | 2 | 45 | 38,000 | 16,000 | 50% |
| | Citric Acid | 10 | | | | |
| 14 | Keto-amine | 5 | 20 | 18,000 | 1,000 | 94% |
| | HCl | 5 | | | | |
| | Sulfamic Acid | 7 | | | | |
| | Glycolic Acid | 3 | | | | |
| | Ammonium Bifluoride | 12 | | | | |
| 15 On Pb | Keto-amine | 2 | 15 | 15,000 | NMA | 100% |
| | Ascorbic Acid | 2 | | | | |
| | Diammonium Citrate | 2 | | | | |

The above examples illustrate that various concentrated acids may be used in connection with the identified keto-amine with good results. Oxalic and citric acids produced the least favorable results. In Example 14, it is noted that ammonium bifluoride is a basic component, thus the solution is not at an extremely low pH, yet 94% of the contamination was removed. Example 15 was performed on a contaminated lead surface. The pH of the decontamination solution of Example 15 is also not at an extremely low pH yet shows a dramatic reduction of contamination levels.

Examples 16–18

The examples shown in Table 4 illustrate various complex keto-amines and additives in a mixture of isopropyl and propargyl alcohols of between 0.1 and 1.0% of the solution with water constituting the balance of the solution. Example 16 was performed using a complex substituted ketoamine derived from a rosin amine and acetone. Examples 17 and 18 were performed using a complex substituted keto-arnine derived from a rosin amine and cyclohexanone (i.e. R" is alpha-cylohexanonyl).

TABLE 4

| Example | Components | % | Time (min) | Start (dpm) | Finish (dpm) | Reduction |
|---|---|---|---|---|---|---|
| 16 | Keto-amine | 2 | 13 | 22,000 | NMA | 100% |
| | HCl | 10 | | | | |
| 17 | Keto-amine | 2 | 15 | 14,500 | 6,350 | 56% |
| 18 | Keto-amine | 2 | 7 | 16,380 | 3,000 | 82% |
| | $CuCl_2$ | 3 | | | | |

These examples show various complex substituted keto-amines which exhibit a reduction in the radioactivity of the surface. Notice that all three of these examples were performed in the absence of a concentrated acid and were over 90% water. Example 18 included copper chloride which improved the decontamination, however a layer of copper was deposited on the surface which may be undesirable in some circumstances.

Examples 19–22

The examples shown in Table 5 illustrate various active agents and other additives in a mixture of isopropyl and propargyl alcohols of between 0.1 and 1.0% of the solution with water constituting the balance of the solution.

TABLE 5

| Example | Components | % | Time (min) | Start (dpm) | Finish (dpm) | Reduction |
|---|---|---|---|---|---|---|
| 19 | Polyethoxy-lated amine | 2 | 10 | 10,000 | 4,000 | 60% |
| | HCl | 15 | | | | |
| 20 Stainless Steel | C10-poly-ethoxylated amine | 10 | 13 | 33,000 | NMA | 100% |
| | Nitric Acid | 25 | | | | |
| | Hydrogen Peroxide | 3 | | | | |
| | Propargyl alcohol | 0.5 | | | | |
| 21 | C6–10 alcohol alkoxylate | 0.05 | 10 | 15,500 | 500 | 97% |
| | HCl | 15 | | | | |
| 22 | C12–15 alcohol alkoxylate | 0.05 | 10 | 6,000 | 2,333 | 61% |
| | HCl | 15 | | | | |

The active agents in Examples 19–22 all show significant reductions in radioactivity of the surfaces tested.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been fully described above with particularity and detail in connection with what is presently deemed to be the most practical and useful embodiments of the invention, it will be apparent to those of ordinary skill in the art that numerous modifications, including, but not limited to, variations in materials, form, function and manner of operation and use may be made, without departing from the principles and concepts of the invention as set forth in the claims.

What is claimed is:

1. A method for removing radioactive contaminants from a surface comprising the steps of:

a) applying to the surface an aqueous solution wherein the aqueous solution comprises a wetting agent and an active agent, said wetting agent being selected from the group consisting of methanol, ethanol, propanol, isopropanot, butanol, propargyl alcohol, tertiary butyl alcohol, pentanol, propylene glycol, polypropylene glycol, ethylene glycol, and mixtures thereof and said active agent being a complex substituted keto-amine having the formula

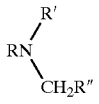

wherein R is selected from the group consisting of abietyl, hydroabietyl, and dehydroabietyl; wherein R" is an alpha ketonyl having fewer than 10 carbon atoms; and wherein R' is either H or $CH_2R''$;

b) retaining the aqueous solution on the surface for a period of time to allow radioactive contaminants to migrate into the aqueous solution; and c) removing the aqueous solution containing the radioactive contaminants from the surface.

2. The method of claim 1, wherein the complex substituted keto-amine has the molecular formula $C_{33}H_{45}NO_2ClH$.

3. The method of claim 1, wherein the alpha ketonyl group is derived from a ketone selected from the group consisting of acetone, methyl ethyl ketone, diacetone alcohol, isophorone, mesityl oxide, pentane dione, acetonyl acetone, cyclopentanone, cyclohexanone, and acetophenone.

4. The method of claim 1, wherein the wetting agent is a mixture of isopropanol and propargyl alcohol.

5. The method of claim 1, wherein the wetting agent comprises between 0.1 and 1.0% by weight of the aqueous solution and the active agent is a complex substituted keto-amine comprising between 0.1 and 2% by weight of the aqueous solution.

6. The method of claim 1, wherein the aqueous solution further comprises an acid selected from the group consisting of hydrochloric acid, hydrofluoric acid, sulfuric acid, phosphoric acid, sulfurous acid, bromic acid, iodic acid, nitric acid, perchloric acid, oxalic acid, aqua regia, citric acid, sulfamic acid, glycolic acid, ascorbic acid, and mixtures thereof.

7. The method of claim 1, wherein the radioactive contaminant is a member of the lanthanide group.

8. The method of claim 1 wherein the radioactive contaminant is a member of the actinide group.

9. The method of claim 1 wherein the radio active contaminant is a member selected from the group consisting of Actinium-227, Americium-241, Americium-243, Antimony-124, Antimony-125, Barium-133, Beryllium-7, Bismuth-207, Cadmium-109, Calcium-45, Carbon-14, Cerium-139, Cerium-141, Cerium-144, Cesium-134, Cesium-135, Cesium-137, Chromium-51, Cobalt-56, Cobalt-57, Cobalt-58, Cobalt-60, Copper-67, Curium-242, Curium-243, Curium-244, Curium-247, Europium-152, Europium-154, Europium-155, Gadolinium-153, Germanium-68, Gold-195, Hafnium-181, Hydrogen-3 (Tritium), Iodine-125, Iodine-126, Iodine-129, Iodine-131, Iodine-133, Iridium-192, Iron-55, Iron-59, Lead-210, Manganese-54, Mercury-203, Neptunium-237, Nickel-59, Nickel-63, Niobium-94, Plutonium-236, Plutonium-238, Plutonium-239, Plutonium-240, Plutonium-241, Plutonium-242, Plutonium-243, Plutonium-244, Polonium-210, Potassium-40, Promethium-147, Protactinium-231, Radium-223, Radium-224, Radium-226, Radium-228, Ruthenium-106, Samarium-151, Scandium-46, Selenium-75, Silver-108m, Silver-110m, Sodium-22, Strontium-85, Strontium-89, Strontium-90, Sulfur-35, Tantalum-182, Technetium-99, Thallium-204, Thorium-natural, Thorium-228, Thorium-230, Thorium-232, Tin-113, Uranium-232, Uranium-233, Uranium-234, Uranium-235, Uranium-236, Uranium-238, Uranium-natural, Uranium-depleted, Yttrium-88, Yttrium-91, Zinc-65, Zirconium-95 and associated decay products thereof.

10. The method of claim 1, wherein steps (a), (b) and (c) are repeated to optimize decontamination.

11. The method of claim 1, wherein the aqueous solution is applied to the surface by spraying.

12. The method of claim 1, wherein the aqueous solution is retained on the surface for a period of less than ten minutes.

13. The method of claim 1, wherein the surface is a member selected from the group consisting of metal, plastic, glass, concrete, wood, fiberglass, fabric, soil and combinations thereof.

14. The method of claim 1, wherein the aqueous solution contains approximately 0% by weight of an acid.

15. The method of claim 1, further comprising the steps of:

a) applying to the surface a second aqueous treatment solution wherein the second aqueous treatment solution comprises a second wetting agent and a second active agent, the second active agent being a member selected from the group consisting of linear alcohol alkoxylates, ethoxylated alkyl amines, and fixtures thereof;

b) retaining the second aqueous treatment solution on the surface for a period of time to allow radioactive contaminants to migrate into the second aqueous treatment solution; and c) removing the second aqueous treatment solution containing the radioactive contaminants from the surface.

16. The method of claim 6, wherein the acid is selected from the group consisting of hydrochloric acid, hydrofluoric acid, sulfuric acid, phosphoric acid, sulfurous acid, bromic acid, iodic acid, nitric acid, and mixtures thereof.

17. The method of claim 6, wherein the aqueous solution has a pH of less than about 1.5.

18. The method of claim 6, wherein the aqueous solution containing radioactive contaminants removed in step (c) is neutralized with an alkaline agent to a pH of between 5.5 and 9.0.

19. The method of claim 6, wherein the acid comprises between about 1% and about 10% by weight of the aqueous solution.

20. The method of claim 11, wherein the step of retaining the solution on the surface is accompanied by brushing the treated surface with an ultrasonic brush to decrease the period of time required to allow radioactive contaminants to migrate into the aqueous solution.

21. The method of claim 13, wherein the surface is metal.

22. The method of claim 13, wherein the surface is a vehicle used for transportation of materials.

23. The method of claim 15, wherein the second active agent is an ethoxylated alkyl amine, said ethoxylated alkyl amine being ethoxylated coco alkyl amine.

24. The method of claim 15, wherein the second active agent is a linear alcohol alkoxylate.

25. The method of claim 15, wherein the second aqueous treatment solution further comprises an acid.

26. The method of claim 17, wherein said acid is hydrochloric acid.

27. The method of claim 18, wherein said alkaline agent is a member selected from the group consisting of sodium hydroxide and potassium hydroxide.

* * * * *